United States Patent [19]

Dumas et al.

[11] Patent Number: 4,506,265

[45] Date of Patent: Mar. 19, 1985

[54] NUCLEAR BLAST RESISTANT PARABOLIC ANTENNA FEED MEANS

[75] Inventors: Ted A. Dumas, Dallas; Maarten Vet, Celina; Sam K. Buchmeyer, Garland, all of Tex.

[73] Assignee: Rockwell International Corporation, El Segundo, Calif.

[21] Appl. No.: 496,079

[22] Filed: May 19, 1983

[51] Int. Cl.[3] ..... H01Q 19/19; H01Q 1/02

[52] U.S. Cl. ..... 343/704; 343/840

[58] Field of Search ..... 343/783, 784, 781 P

[56] References Cited

U.S. PATENT DOCUMENTS 3,071,770 1/1963 Wilkes ..... 343/840

3,917,773 11/1975 Gates, Jr. et al. ..... 343/911 R

*Primary Examiner*—Maynard R. Wilbur

*Assistant Examiner*—M. R. Gordon

*Attorney, Agent, or Firm*—Bruce C. Lutz; V. Lawrence Sewell; H. Fredrick Hamann

[57] ABSTRACT

The aftermath of a nuclear explosion generates a large amount of heat or infrared energy. When this heat is received by a parabolic reflector type antenna, the level of heat concentrated on the focal area of the feed is very intense. The present invention utilizes a highly heat conductive ceramic plug between the splash plate at the focal area of the feed and the waveguide so that heat can be readily conducted away from the splash plate and thereby minimize operational destruction of this splash plate due to thermal overload. The heat conductor material is a ceramic which is substantially transparent to RF signals being received by, or transmitted from the waveguide of the antenna system.

4 Claims, 1 Drawing Figure

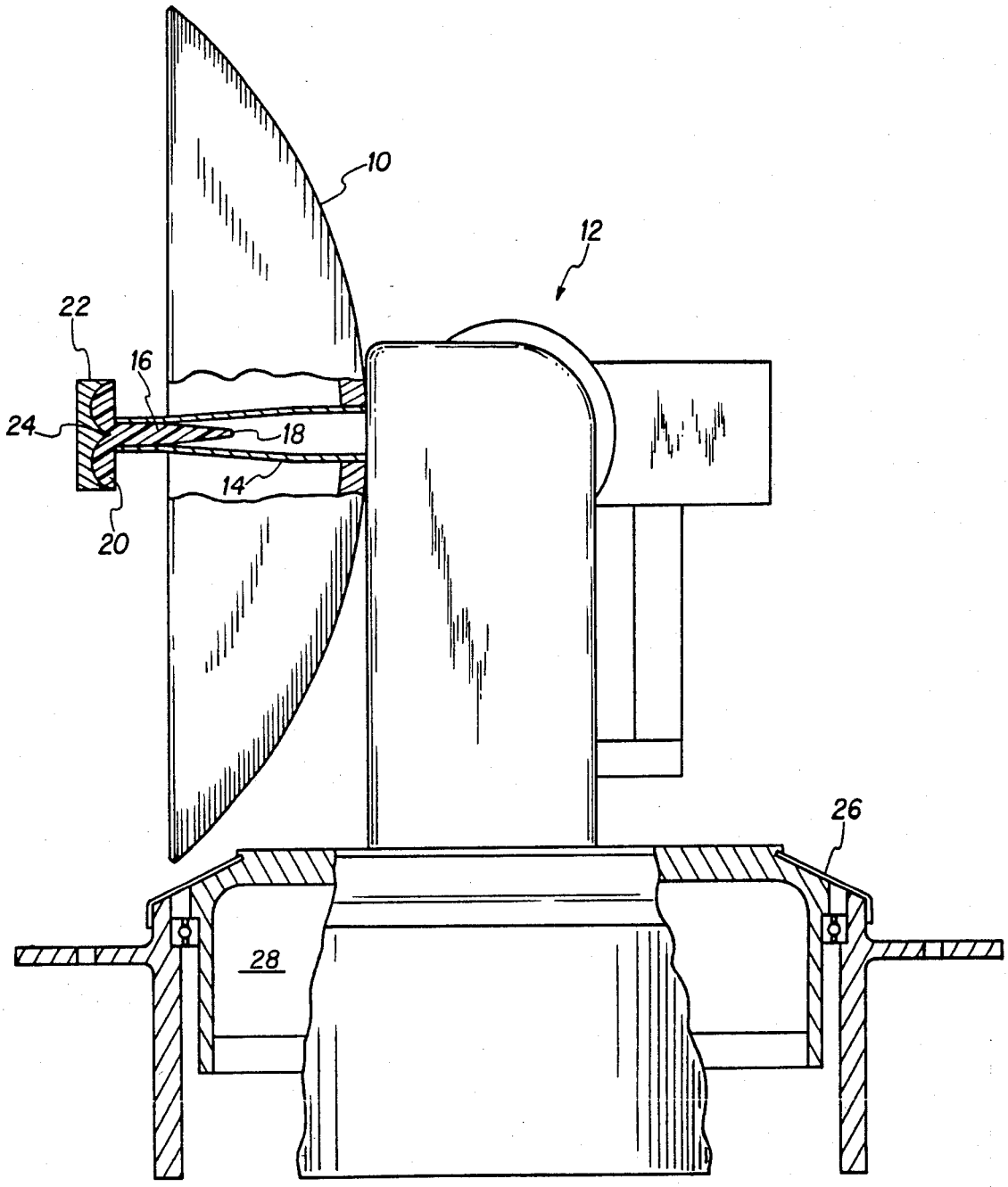
10
12
22
16
24
18
14
20
26
28

NUCLEAR BLAST RESISTANT PARABOLIC ANTENNA FEED MEANS

INVENTION

The present invention is directed generally to antenna systems and more specifically to the splash plate in the focal area of the feed portion of a parabolic reflector antenna. Even more specifically, the invention is concerned with the destruction of the splash plate under the stress of a nearby nuclear explosion and the resulting thermal or infrared radiation.

While any antenna that is in the immediate vicinity of a nuclear explosion cannot be expected to survive, it would be highly desirable if antennas at the two to three mile range be capable of operating for at least a period of time after the attack. The usual means for making such an antenna resistant to nuclear attack is to house the antenna in a ceramic radome to protect it from the anticipated thermal loading. The radome degrades electrical performance since it is usually several wavelengths in thickness and ray angles through the thickness are not uniform. Such a radome is also very costly compared to the present approach which provides a means for protecting the splash plate at the focal area of the feed for the antenna from the high concentrations of infrared energy focused on the splash plate. It would of course be desirable that the antenna also include other features of antennas, not protected by radomes, such as a wind resistant heavy superstructure or base. It should also use a parabolic reflector with a surface that is relatively rough at thermal ray frequencies, thus dispersing many of the thermal waves rather than redirecting them to the focal area of the feed. Further, the RF waveguide and rotary joints are constructed with heavy metal walls so that the short time constant of the high thermal energy does not seriously affect operation.

The present invention utilizes a high thermal conductivity ceramic between the splash plate or subreflector, located at the focal area of the antenna signal feed, and the waveguide comprising a major portion of the antenna signal feed. The ceramic is used to conduct heat away from the splash plate and prevent its destruction due to thermal overloads occurring in conjunction with the concentration of infrared signal energy from the antenna on the focal area.

It is therefore an object of the present invention to improve the survivability of an antenna situated near the site of a nuclear blast.

Other objects and advantages of the present invention may be ascertained from the reading of the specification and appended claims in conjunction with the single drawing which shows a typical antenna incorporating the splash plate heat dissipator of the inventive concept.

DETAILED DESCRIPTION

In the drawing, a dish 10 having a parabolic surface reflector is mounted on a superstructure generally designated as 12. The mounting 12 is designed in accordance with well-known techniques to allow the parabola 10 to be reoriented to a plurality of positions within a hemispheric set of orientations. A waveguide 14 is shown mounted on the reflector surface 10 and attached to the superstructure or base 12. Within the waveguide 14 is a piece of ceramic 16 which is tapered to a point designated as 18, having an upper portion 20 which is shaped to conform to a reflector portion of the focal area of the feed splash plate or subreflector 22. The splash plate 22 has a central focal area in the form of a point 24. This focal area is part of a concavity which is generally toroidally shaped. The concavity acts to reorient the focused RF signals from the parabolic reflector into the waveguide. The entire device 22 is bonded to the ceramic plug 16 which in turn is bonded to the waveguide 14 for good heat conduction from splash plate 22 to the waveguide 14.

Although not shown in detail, the reflective surface of dish 10 should be a surface which acts as a parabola to focus the relatively long RF rays and yet be a surface which is relatively rough at thermal ray frequencies and thus disperses the thermal rays rather than focusing them.

The surface can be roughened by various means such as shot peening or other means and then made corrosion resistant by finishing with a plating such as nickel or chrome. The dish proper 10, however, will still focus the RF communication rays after the shot peening.

Structural material, such as the entire remaining base of the antenna 12, should be made of a heavy material such as steel or iron to provide the mass necessary to maintain relatively low maximum antenna temperatures in the range of 600 degrees F. It is good practice to finish the exposed surface with thermally dispersive paint. The interfaces between moving joints are desirably bridged with a teflon material such as designated by designator 26. This material provides a "non-stick" surface to minimize icing. Since teflon sublimes rather than melts, it will disappear upon the occurrence of a nuclear blast rather than bind as could happen with thermoplastics or rubbers.

Operating devices such as motors and sliprings would be located below the lower azimuth axis such as within the enclosure designated 28. These components are thus shielded from the heat by the structure surrounding same.

The RF waveguide 14 and the various rotary joints should be constructed with heavy metal walls. It is also desirable that the interior surfaces be silver plated to minimize the loss in the RF rays.

OPERATION

While the operation of parabolic reflector antennas are well known to those skilled in the art, a few comments will be made as to antenna operation as well as the application of the present inventive concept to the survivability of an antenna in the vicinity of a nuclear explosion. The plug 16 requires a smoothly tapered point 18, since any sudden discontinuities will severely affect the transmission of the RF signals therethrough within the waveguide 14. Such gradual changes (no discontinuities), of course, are standard in high frequency waveguide design practice. Signals transmitted from the antenna proceed up the waveguide 14 through the plug 16 and are distributed from the splash plate or subreflector 22 as they are reoriented in the concavity of splash plate 22 to the parabolic reflector surface of reflector 10. The signals being received by the antenna go in the reverse direction from the reflector surface of parabola 10 to the concavity of splash plate 22 and down the waveguide 14 to the receiving apparatus.

As previously mentioned, even though the surface of the reflector 10 may be roughened to disperse a majority of infrared signals, there are still a sufficient quantity of infrared signals which are passed to the concavity of splash plate 22 whereby the splash plate 22 is heated to a very high temperature. If means were not provided to dissipate this heat, the splash plate 22 would typically get hot enough to distort or otherwise interrupt operation. By using a ceramic dielectric or insulator for plug 16 which is relatively highly heat conductive, and bonding this ceramic device to both the splash plate 22 and the waveguide 14, heat can be conducted from splash plate 22 to the waveguide 14 and thus dissipated to the rest of the superstructure 12.

While one embodiment of the inventive concept has been illustrated using a high conductivity ceramic, such as beryllia at the antenna feed, it will be obvious that other approaches may be used to dissipate the heat which occurs upon the reflection of the infrared waves to a focal area of the splash plate 22. Thus, we wish to be limited not by the specific implementation illustrated and described but only by the scope of the appended claims wherein we claim.

We claim:

1. Apparatus for maintaining RF antenna operation during the thermal phase of a nuclear blast comprising, in combination:

superstructure means;

parabolic antenna means mounted on said superstructure means;

RF signal focusing means mounted at the focal point of said parabolic antenna means;

heat conducting waveguide means mounted on said superstructure means; and high heat conductivity ceramic attached between said focusing means and said waveguide means for conducting heat energy away from said focusing means to the waveguide means while passing RF received signals through said ceramic means.

2. Apparatus for dissipating heat generated by the concentration of infrared signals at the focal area of a parabolic reflector RF antenna feed comprising in combination:

splash plate means;

feed means including waveguide portion means;

heat conductive, but substantially RF signal transparent, plug means in said waveguide portion means of the feed adjacent the splash plate; and means for bonding the plug to both said waveguide portion means and said splash plate means for facilitating heat transmission from said splash plate means to said waveguide portion means.

3. Apparatus for maintaining RF antenna operation during the thermal phase of a nuclear blast comprising, in combination:

superstructure means comprising ferrous metals of substantial dimensions to provide adequate heat sink capability to protect internally mounted components;

parabolic antenna means mounted on said superstructure means, said parabolic antenna means having a surface which appears dispersing to thermal rays and concentrating to RF rays;

RF signal focusing means mounted at the focal point of said parabolic antenna means;

heat conducting waveguide means mounted on said superstructure means;

high heat conductivity ceramic attached between said focusing means and said waveguide means for conducting heat energy away from said focusing means to the waveguide means while passing RF received signals through said ceramic means; and means for mounting heat sensitive electrical apparatus within said superstructure means.

4. Apparatus as claimed in claim 3 comprising, in addition:

teflon moving joint interface means for minimizing icing.

* * * * *